US008369554B2

(12) United States Patent
Oberlander

(10) Patent No.: US 8,369,554 B2
(45) Date of Patent: Feb. 5, 2013

(54) OPEN TIP FOR HEARING AID

(75) Inventor: Dennis A. Oberlander, Queen Creek, AZ (US)

(73) Assignee: Zounds Hearing, Inc., Phoenix, AZ (US)

( * ) Notice: Subject to any disclaimer, the term of this patent is extended or adjusted under 35 U.S.C. 154(b) by 872 days.

(21) Appl. No.: 12/286,939

(22) Filed: Oct. 3, 2008

(65) Prior Publication Data

US 2010/0086158 A1 Apr. 8, 2010

(51) Int. Cl.
*H04R 25/00* (2006.01)

(52) U.S. Cl. ..... 381/328; 381/322; 381/324; 381/325; 381/330; 381/380

(58) Field of Classification Search ..... 381/328, 381/330, 322, 324, 325, 380
See application file for complete search history.

(56) References Cited

U.S. PATENT DOCUMENTS

| | | | | |
|---|---|---|---|---|
| 2,939,923 | A | 6/1960 | Henderson | 179/182 |
| 4,727,582 | A | 2/1988 | de Vries et al. | 381/68.7 |
| 5,606,621 | A | 2/1997 | Reiter et al. | 381/68.6 |
| 5,887,070 | A | 3/1999 | Iseberg et al. | 381/380 |
| 6,048,305 | A | 4/2000 | Bauman et al. | 600/25 |
| 6,473,513 | B1 | 10/2002 | Shennib et al. | 381/328 |
| 6,819,770 | B2 | 11/2004 | Niederdränk | 381/322 |
| 7,016,512 | B1 | 3/2006 | Feeley et al. | 381/324 |
| 7,113,611 | B2 | 9/2006 | Leedom et al. | 381/322 |
| 2005/0078843 | A1 | 4/2005 | Bauman | 381/312 |
| 2006/0215864 | A1* | 9/2006 | Espersen et al. | 381/330 |
| 2007/0195981 | A1 | 8/2007 | Le | 381/330 |
| 2008/0013767 | A1* | 1/2008 | Olsen et al. | 381/328 |
| 2008/0019549 | A1* | 1/2008 | Ochsenbein | 381/325 |
| 2008/0152178 | A1* | 6/2008 | Topholm et al. | 381/330 |
| 2008/0187159 | A1* | 8/2008 | Blanchard | 381/328 |
| 2008/0298618 | A1* | 12/2008 | Baumann et al. | 381/325 |

* cited by examiner

*Primary Examiner* — Andy Huynh
(74) *Attorney, Agent, or Firm* — Cahill Glazer PLC

(57) ABSTRACT

An earpiece includes an open tip in the shape of a dome, with apertures in the dome and a protrusion at the top of the dome for displacing ear wax, wherein the dome merges with the protrusion along a continuous curve. The dome is supported from a central body by non-linear ribs that normally have high compliance but exhibit low compliance at a limit of extension or compression. The tip can include more than one dome on the central body. If there is more than one dome, the apertures in the domes are not aligned with each other.

8 Claims, 1 Drawing Sheet

OPEN TIP FOR HEARING AID

This invention relates to hearing aids and, in particular, to a tip for insertion in the ear canal, wherein the tip does not significantly occlude the canal.

BACKGROUND TO THE INVENTION

A "speaker" generates sound from an electrical signal. In the hearing aid art, one often encounters the term "receiver" for such a device, which reads strangely to the uninitiated. "Electroacoustic transducer" is clumsy and pedantic. Thus, "speaker" is the term used for describing this invention.

A human ear canal is a narrow, irregular, tubular structure, approximately 25 mm in length and 7 mm. (0.28 inches) or more in diameter. Coupling amplified sound to the eardrum at the inner end of the canal is not as simple as it might, seem. In a hearing aid, a microphone is connected to a speaker by a high gain (60-80 dB) amplifier and is relatively close to the speaker. Feedback is a problem, much less so in a behind-the-ear (BTE) hearing aid that separates the microphone and the speaker by both distance and the tissue of the outer ear.

Hearing aids can be divided into four groups: Behind-The-Ear (BTE), In-The-Ear (ITE), In-The-canal (ITC), and Completely-In-the-Canal (CIC). It has long been known that putting the speaker in the ear canal reduces feedback in a BTE hearing aid. See "Reducing Feedback in a Post-Auricular Hearing Aid by Implanting the Receiver in an Earmold", Ross and Cirmo, *The Volta Review*, January 1980, pages 40-44. (Post auricular means behind the ear). See also U.S. Pat. No. 4,727,582 (de Vries et al.). As Dr. Ross noted in the July/August, 2006, issue of *Hearing Loss*, "Ironically, some of the very first generation of BTE hearing aids included an external button receiver, simply because there was insufficient room for a receiver in the hearing aid case itself." Putting a speaker in the ear canal is not so much a hearing aid innovation as a credit to the speaker manufacturers for making their products ever smaller. As Dr. Ross noted in the same article, "because the receivers are now so small, it is possible to also obtain the acoustic advantages of an open ear fitting" with a speaker in the ear canal.

Occlusion and feedback are opposed considerations. Feedback is fairly well defined and can be controlled mechanically and electronically. Occlusion reduces feedback. Occlusion produces the sensation that the ear is plugged, making speaking, chewing, or brushing ones teeth seem very loud. Occlusion is subjective; e.g. U.S. Application Publication 2005/0078843 (Bauman) reports an experimental error of 5-11 dB for insertion effect and more than approximately 3-8 dB for occlusion effect.

Occlusion is treated inconsistently in the prior art. For example, some patents disclose that vents do not prevent occlusion while other patents disclose that vents are effective. Some patents split the difference and say that occlusion depends upon the size of the vent. Other patents express occlusion as a percent. "If the external ear canal . . . is sufficiently open (approximately 50 percent), the ear canal resonance is unchanged and the wearer reports normal sound quality;" U.S. Pat. No. 6,048,305 (Bauman et al.).

U.S. Pat. No. 6,473,513 (Shennib et al.) discloses that occlusion in minimized by placing a "sealing retainer" as far into the canal as practical and provides a gap between the body of a hearing aid and the ear canal to prevent occlusion. The sealing retainer contains a speaker that is electrically coupled to the body of the hearing aid. Whether because of a vent, a gap, or a loose fitting, it is known in the art that occlusion is minimized with an "open" canal.

A host of ear tips have been proposed in the art for locating a tube or a speaker in the ear canal. Variously identified as umbrella, mushroom, dome, jellyfish-shaped tips, such tips have been known in the art for a long time, e.g., U.S. Pat. No. 2,939,923 (Henderson). Plural, dome-shaped tips on a single speaker are disclosed in U.S. Pat. No. 5,887,070 (Iseberg et al.).

Tips are made of a resilient, compliant material and therein lies a problem. Removing the tip often causes the tip to invert in the ear canal, somewhat like an umbrella in a high wind. This can be uncomfortable for the user. U.S. Pat. No. 7,113,611 (Leedom et al.) discloses ribs between the skirt of an ear tip and the stem of the ear tip for preventing inversion. Although effective, the ribs stiffen the tip. High compliance also permits migration of the tip in the canal, which can cause occlusion and further annoyance.

Another problem with tips is the accumulation of debris, notably ear wax, especially if the ear canal is not open. A variety of techniques have been proposed, including tiny filters, to prevent debris from entering the opening for allowing sound to emerge from the tip. The accumulation of debris remains a problem.

In view of the foregoing, it is therefore an object of the invention to provide an ear tip for a hearing aid that minimizes occlusion Another object of the invention is to provide a tip for a hearing aid that reduces the accumulation of debris.

A further object of the invention is to provide limited, compliant support for the flared portion of a dome-shaped ear tip.

SUMMARY OF THE INVENTION

The foregoing objects are achieved by this invention in which the earpiece includes an open tip in the shape of a dome, with apertures in the dome and a protrusion at the top of the dome for displacing ear wax, wherein the dome merges with the protrusion along a continuous curve. The dome is supported from a central body by non-linear ribs that normally have high compliance but exhibit low compliance at a limit of extension or compression. The tip can include more than one dome on the central body. If there is more than one dome, the apertures in the domes are not aligned with each other.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
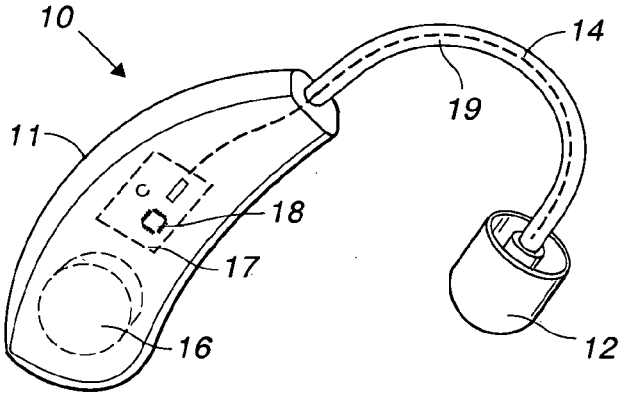
FIG. 1 illustrates a BTE hearing aid having an ear tip constructed in accordance with the invention.

In FIG. 1, hearing aid 10 includes housing 11 coupled to earpiece 12 by cable 14. Within housing 11 are battery 16 and circuit board 17. Circuit board 17 includes programmed microprocessor 18 and other circuitry for processing audio signals, charging battery 16, and other functions. A speaker (not shown) is located in earpiece 12 and a microphone (not shown) is located in housing 11. The speaker is coupled to circuit board 17 by wires 19 in cable 14.

Figure 2:
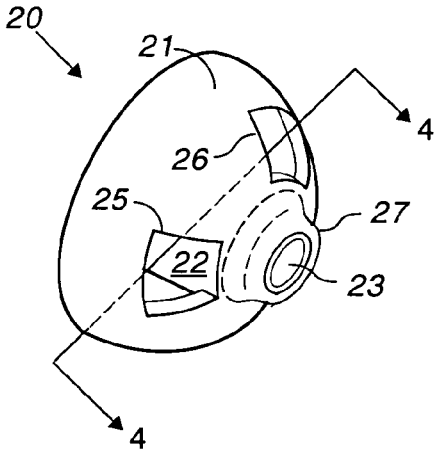
FIG. 2 is a perspective view of an open ear tip constructed in accordance with a preferred embodiment of the invention.

In FIG. 2, open ear tip 20 includes dome 21 coupled to hollow central body 22, preferably formed as a single piece. Body 22 is mechanically coupled to a speaker (not shown) and conveys sound along tubular passageway 23 to the ear canal. Dome 21 defines a plurality of apertures, such as apertures 25 and 26, which are preferably located regularly about the longitudinal axis defined by passageway 23. On the top of dome 21 is protrusion 27 that provide deflection for debris way from passageway 23 toward the wall of the ear canal in which tip 20 is located.

Figure 3:
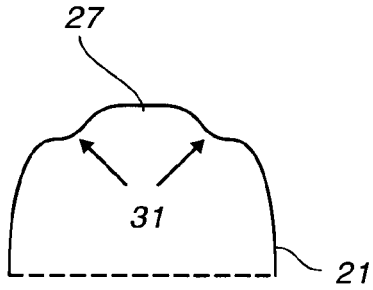
FIG. 3 illustrates a detail of FIG. 2.

In accordance with one aspect of the invention, protrusion 27 merges with dome 21 without a corner or discontinuity. As illustrated in FIG. 3, protrusion 27 merges with dome 21 along ogee 31. Any continuous curve can suffice. Mathematically, the curve is differentiable along the entire path from dome 21 to protrusion 27. By avoiding discontinuities, it has been found that protrusion 27 provides deflection and does not provide any pockets or recesses that may store debris or become directed into passageway 23.

Figure 4:
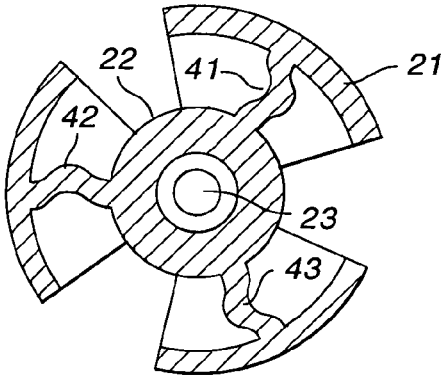
FIG. 4 is a cross-section along lines 44 in FIG. 2.

In accordance with another aspect of the invention, illustrated in FIG. 4, the walls of dome 21 are coupled to central body 22 by ribs 41, 42, and 43 located radially between apertures. The ribs are not linear but serpentine, in a preferred embodiment of the invention. The serpentine configuration allows greater compliance but with limits. The limits are reached when a rib is straightened out by outwardly deflecting a portion of dome 21 or by compressing a portion of the dome in the vicinity of a rib. Within these limits, dome 21 can be extremely compliant, almost as though the ribs were not there. At a limit, dome 21 is much less compliant and cannot invert, for example.

Figure 5:
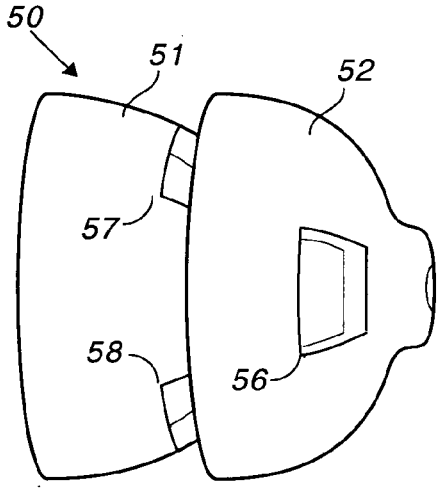
FIG. 5 is a perspective view of an open ear tip constructed in accordance with an alternative embodiment of the invention.

FIG. 5 illustrates an alternative embodiment of the invention in which open ear tip 50 includes plural domes; specifically, domes 51 and 52. The apertures in dome 51 are not aligned with the apertures in dome 52. Stated another way, aperture 56 in dome 52 is preferably aligned with the portion of dome 51 that lies between aperture 57 and aperture 58. This provides a longer path for ambient sound traveling past tip 50.

Figure 6:
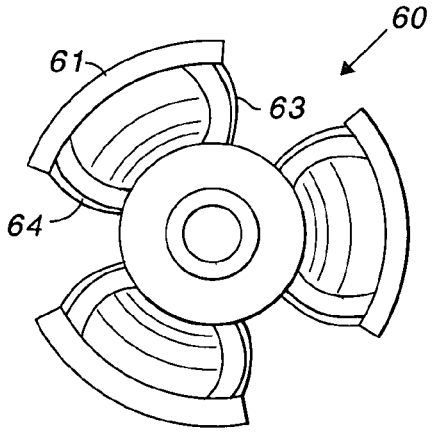
FIG. 6 is an end view of an open ear tip constructed in accordance with an alternative embodiment of the invention.

FIG. 6 is an end view of an alternative embodiment of the invention in which the apertures extend to lower rim or outer rim 61 of tip 60, forming three petals. Rather than being serpentine, the ribs, such as ribs 63 and 64, have a single curve.

The invention thus provides an ear tip that minimizes occlusion and reduces the accumulation of debris. The invention also provides compliant support for the flared wall of a dome-shaped ear tip, wherein the compliance stiffens at the limits of motion or extension of the support.

Having thus described the invention, it will be apparent to those of skill in the art that various modifications can be made within the scope of the invention. For example, the ribs can have an accordion shape or other shape as long as the rest position causes the wall of dome 21 to be closer to central body 22 than the extended position. Open ear tips constructed in accordance with the invention can be attached to a speaker by any suitable means, such as adhesive, frictional fit, or interference fit such as a ridge and a groove.

What is claimed as the invention is:

1. A hearing aid including an earpiece, wherein the earpiece is located in an ear canal during use and contains a speaker, characterized in that the earpiece includes an open tip in the shape of a dome joined to a central body, the dome including walls, and the walls of the dome having an inner surface generally facing the central body, with radially-spaced apertures in the dome and non-linear ribs extending between the apertures from the inner surface of the walls of the dome to the central body for supporting the dome.

2. The hearing aid as set forth in claim 1 wherein said non-linear ribs have a serpentine shape.

3. A hearing aid comprising in combination:

a. an earpiece adapted to be inserted in a user's ear canal during use;

b. a speaker contained in the earpiece;

c. the earpiece including an open tip, the open tip including:

I. a central body, ii. a first dome joined to the central body and having a first plurality of spaced apertures formed therein, iii. a second dome joined to the central body and having a second plurality of spaced apertures formed therein, and iv. wherein the first plurality of spaced apertures in the first dome are not radially aligned with the second plurality of spaced apertures in the second dome.

4. An open tip for a hearing aid, comprising in combination:

a. a dome including a top and including curved walls extending from the top to a circular base;

b. a central body having first and second opposing ends, the first end of the central body being coupled to the top of the dome, and the central body extending substantially within the dome;

c. a plurality of apertures formed within the curved walls of the dome, the plurality of apertures being spaced radially apart from each other; and d. a plurality of non-linear ribs extending between the central body and the curved walls of the dome to aid in supporting the dome from the central body.

5. The open tip recited by claim 4 wherein the non-linear ribs are radially spaced apart from each other.

6. The open tip recited by claim 4 wherein each non-linear rib extends radially between two successive apertures.

7. The open tip recited by claim 4 wherein the central body is generally cylindrical.

8. The open tip recited by claim 7 wherein the central body is hollow and includes a tubular passageway.

* * * * *